US005332943A

United States Patent [19]

Bhardwaj

[11] Patent Number: 5,332,943

[45] Date of Patent: Jul. 26, 1994

[54] HIGH TEMPERATURE ULTRASONIC TRANSDUCER DEVICE

[76] Inventor: Mahesh C. Bhardwaj, 238 E. Doris Ave., State College, Pa. 16801

[21] Appl. No.: 140,270

[22] Filed: Oct. 21, 1993

[51] Int. Cl.[5] ..... H04R 17/00

[52] U.S. Cl. ..... 310/326; 310/327; 310/336; 73/644

[58] Field of Search ..... 310/326, 327, 334, 336, 310/346; 73/644, 861.18

[56] References Cited

U.S. PATENT DOCUMENTS

| | | | |
|---|---|---|---|
| 3,387,604 | 6/1968 | Erikson | 310/326 |
| 3,663,842 | 5/1972 | Miller | 310/326 |
| 3,781,576 | 12/1973 | Runde et al. | 310/9.1 |
| 3,921,442 | 11/1975 | Soloway | 73/644 |
| 4,549,107 | 10/1985 | Kaneko et al. | 310/327 |
| 4,703,656 | 11/1987 | Bhardwaj | 73/644 |
| 4,741,216 | 5/1988 | Bates et al. | 73/861.12 |
| 4,783,997 | 11/1988 | Lynnworth | 73/644 |
| 5,156,050 | 10/1992 | Schmid et al. | 73/644 |
| 5,195,373 | 3/1993 | Light et al. | 73/632 |
| 5,214,343 | 5/1993 | Baumoel | 310/334 |

*Primary Examiner*—Thomas M. Dougherty
*Attorney, Agent, or Firm*—Webb Ziesenheim Bruening Logsdon Orkin & Hanson

[57] ABSTRACT

A hard faced contact ultrasound transducer device for transmitting ultrasound pulses into a workstructure at temperatures substantially above room temperature comprises a ceramic protection block, a piezoelectric element bonded to the protecting block, a damping substrate adjacent the piezoelectric element, a ceramic clamping block with standoff portions that limit the approach of the clamping block toward the ceramic protecting block, and fasteners to draw the clamping block toward the protecting block forcing the damping substrate against the piezoelectric element and the protecting block.

3 Claims, 2 Drawing Sheets

HIGH TEMPERATURE ULTRASONIC TRANSDUCER DEVICE

FIELD OF THE INVENTION

This application relates to high temperature resistant ultrasound transducer devices which are devices that support and protect a piezoelectric element in an environment that both insures operation when the device is placed in contact with surfaces at elevated temperatures and insures that the element can transmit and receive ultrasound pulses having certain desirable characteristics.

BACKGROUND OF THE INVENTION

Ultrasound, among its many applications, is used for nondestructive testing and nondestructive characterization of components and materials. It can be used for the detection of defects in components, the determination of properties of materials, the detection of thickness and proximity sensing to mention a few uses.

Many industrial manufacturing processes involve the use of high temperatures and pressures to facilitate chemical and physical reactions in the formation of materials, components and structures. Some processes involve high temperatures and corrosive environments. Some even involve thermal cycling. These conditions are often encountered in the manufacture of metals, ceramics and plastics. They are also encountered in the processing of petroleum and in the generation of energy in nuclear, fossil fuel and hydroelectric power plants. It is highly desirable to be able to monitor such processes and the structures used in the practice of such processes with the use of ultrasound. To do so, it is necessary to have ultrasound transducers that will function in these difficult environments.

Applicant's invention specifically relates to ultrasound transducers for these and other uses at high temperatures.

High temperature resistant ultrasound transducer devices are known in the art. An example is the applicant's U.S. Pat. No. 4,703,656 entitled "Temperature Independent Ultrasound Transducer Device". Other patents in the pertinent art comprise Runde et al. U.S. Pat. No. 3,781,576 entitled "High Temperature Ultrasonic Transducer"; Zacharias U.S. Pat. No. 4,505,160 entitled "High-Temperature Transducer"; Lynnworth U.S. Pat. No. 4,783,997 entitled "Ultrasonic Transducer for High Temperature Applications" and Light et al. U.S. Pat. No. 5,195,373 entitled "Ultrasonic Transducer for Extreme Temperature Environments".

A persistent problem with certain of the high temperature ultrasound transducer devices is maintaining intimate contact between the piezoelectric element and the protecting or delay block to which it is secured. The adhesives available for making the contact deteriorate at high temperatures and under ultrasound induced conditions. Some commercially available ultrasound transducer devices use organic epoxies for bonding the piezoelectric element to a protecting or delay block comprised of a high temperature resistant polyamide plastic. Even at a temperature of about 200° C., bonds between the piezoelectric elements and the plastic protecting or delay blocks separate. Moreover, the plastic delay blocks themselves deform when subjected to a temperature of about 500° C. It should be understood that while the transducer devices are placed into contact with very high temperatures, the temperature of the piezoelectric elements themselves must not exceed the Curie point (temperature) of the elements at which temperatures the piezoelectric properties are lost. This is achieved by maintaining a temperature gradient between the component or process to which ultrasound pulses are being applied and the piezoelectric element.

Mechanical clamping has been suggested to secure the piezoelectric element to the protection or delay block. However, mechanical clamping itself has certain drawbacks relating to the ability of the transducer to produce pulses useful in testing applications. It is necessary that the ultrasound pulses of selected frequency distribution and pulse width be transmitted without undesirable echoes and/or attenuations resulting from the transducer structure itself.

It is an object of this invention to provide a high temperature resistant ultrasound transducer device that can be configured to provide a narrow ultrasound pulse having a frequency between less than 0.25 to greater than 10 megahertz at contact face temperatures up to about 1500° C. for short times and at lesser temperatures for longer times.

It is a further object of this invention that the premature failure of the bond between the piezoelectric element and the delay block is eliminated by a mechanical structure that holds all components in place while permitting the piezoelectric transducer to generate pulses of desired frequency, frequency distribution and pulse width without undesired echoes and/or attenuations.

It is a still further object of this invention that the pulse width and attenuation characteristics of the transducer devices are not unacceptably reduced at elevated temperatures and delay times remain stable over long periods of time.

SUMMARY OF THE INVENTION

Briefly according to this invention there is provided a hard faced contact ultrasound transducer device suitable for transmitting ultrasound pulses into a workstructure at temperatures substantially above room temperature. The device comprises a ceramic protecting or delay block having inner and outer surfaces. The outer surface or contact face is configured to contact the workstructure. The front side of a piezoelectric element is bonded to the inner surface of the protecting block. The front side of a damping substrate is adjacent the back side of the piezoelectric element. A ceramic clamping block has a contact face positioned facing the back side of the damping substrate. The clamping block has standoff portions that limit the movement of the clamping block toward the ceramic protecting block. Fasteners draw the clamping block toward the protecting block forcing the damping substrate against the piezoelectric element and the protecting block. Preferably a thin ceramic cloth, mesh or felt is placed between the clamping piece and the back of the damping substrate. The ceramic cloth has a slight amount of resilience. Thus, the piezoelectric element is mechanically held against the protecting piece.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

As explained, a major weakness of the prior art high temperature resistant ultrasonic transducer devices is the premature failure of the critical bond between the piezoelectric element and plastic delay block. It is an advantage of this invention to eliminate this problem by securing the critical piezoelectric element to a reliable high temperature resistant delay block with an especially designed clamping block. This clamping block holds all critical components in place, thus maintaining a complete electrical circuit while the transducer is being excited by an electrical pulse, even at elevated temperatures.

Figure 1:
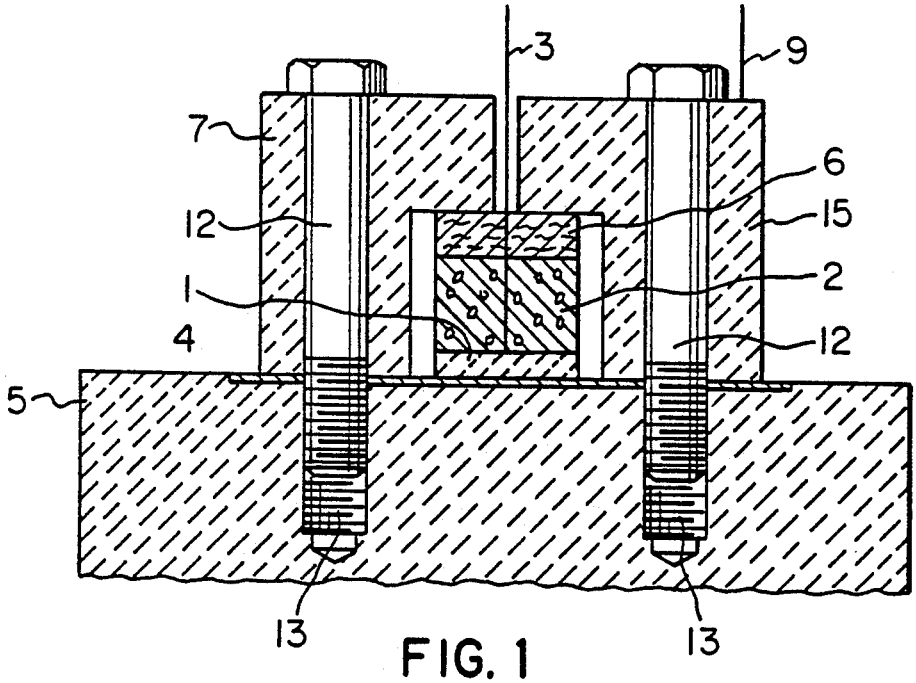
FIG. 1 is an enlarged section of part of an ultrasound transducer device according to this invention.

Referring now to FIG. 1, a piezoelectric element 1 is positioned between a damping substrate 2 and protecting and delay block 5. A high temperature resistant electrically conductive adhesive 4 bonds the piezoelectric element 1 to the protecting block 5. A positive electrode lead 3 connects to the back side of the piezoelectric element. The conductive adhesive 4 is grounded by ground lead 9. In this way an exciting pulse can be applied to the piezoelectric element. A clamping block 7 is arranged with a pressure face at the back side of the damping substrate 2. A high temperature cushion 6 comprised of a thin sheet of ceramic cloth, mesh or felt is positioned between the pressure face of the clamping block and the back side of the damping substrate. The clamping block 7 has bores therein through which bolts 12 pass. The protecting block has threaded bores 13 into which the bolts 12 are threadably engaged. As the bolts are turned down into the bores, the clamping block 7 is drawn against the back side of the damping substrate. The clamping block is provided with a stand off portion or skirt 15 to limit the downward movement of the clamping block relative to the damping substrate.

Figure 2:
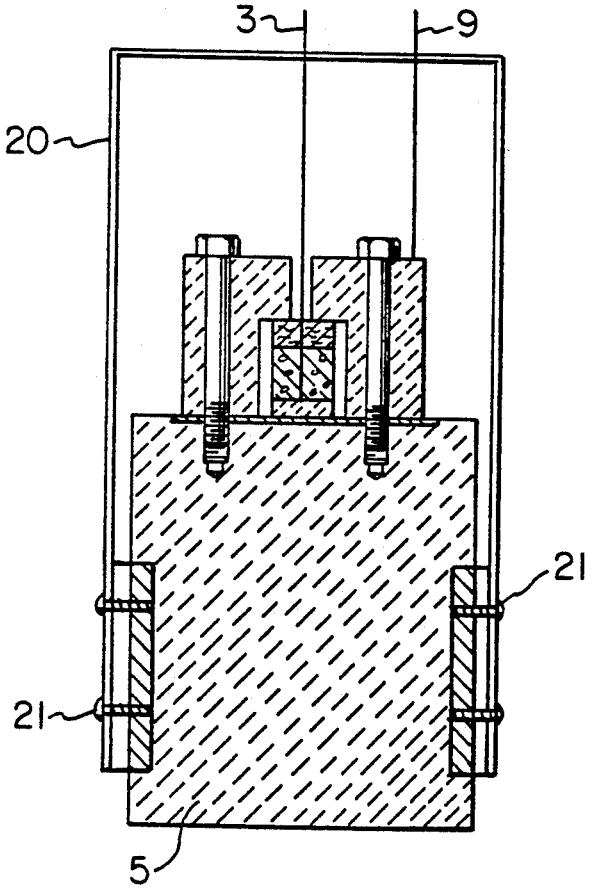
FIG. 2 is section view of the complete device shown in FIG. 1.

Referring now to FIG. 2, there is shown the apparatus of FIG. 1 with the protecting block comprising an elongate ceramic delay block and with a metal canister housing 20 surrounding the transducer device. The canister housing 20 is secured to the ceramic delay block by set screws 21. In addition to the positive lead 3, the ground lead 9 is shown in FIG. 2.

This configuration is highly desirable when a single transducer is used simultaneously as a transmitter and receiver of ultrasound, such as in direct reflection ultrasonic techniques. Most common applications are thickness, velocity, defects, properties measurements or materials.

The active piezoelectric element used according to this invention is preferably one which is characterized by high Curie point, made from materials such as low $Q_m$ lead meta niobate, lithium niobate, quartz, and other like materials.

The high temperature damping substrate is preferably cementatious and can be directly bonded to active piezoelectric element. Two variations are possible: Electrically nonconductive damping substrates may be comprised of inorganic cements filled with $SiO_2$, $Al_2O_3$, $ZrO_2$, SiC particles or fibers and like materials. In this case, the positive electrode lead 3 is directly in contact with high temperature metallized face of the active piezoelectric element 1. Electrically conductive damping substrates may comprise particles or powders of metals (Cu, Fe, Cr, Ni, W, Mo and other like metals) bonded by graphite based inorganic adhesives or cements, or Ag, Cu, Al based very high temperature resistant epoxies. In this case, the positive electrode lead 3 can be located anywhere inside the substrate that is bonded to active piezoelectric material 1.

The positive lead is an electrically conductive wire. In some embodiments, the electrode lead may comprise wire such as used in making thermocouples.

High temperature resistant electrically conductive adhesives are comprised of metal (Cu, Fe, Cr, Ni, W, Mo and other like metals) or graphite based inorganic adhesives or cements, or Ag, Cu, Al based very high temperature resistant epoxies. By using such a material, the assembly composed of active piezoelectric element 1 and damping substrate 2 is directly bonded to piezoelectric protecting or delay block 5. As an alternate to the adhesive described here, a suitable high temperature brazing alloy can also be used between active piezoelectric element 1 and piezoelectric protecting or delay block 5.

Alternatively, thin inorganic cement or thin glassy bond can also be used between piezoelectric element and piezoelectric protecting or delay block 5. In this case, the piezoelectric protecting or delay material surface must be metallized with thin high temperature coating such as those composed of fired-on silver-glass or other similar mixture.

The protecting or delay blocks are made from very high temperature resistant materials such a those that are composed of $SiO_2$, $Al_2O_3$, $ZrO_2$, Sic, and crystalline or glassy composites thereof.

The high temperature cushion is a ceramic wool or tape composed of $SiO_2$, $Al_2O_3$, $ZrO_2$ or similar materials. This cushion is placed between the top part of the damping substrate 2 and high temperature resistant and electrically nonconductive clamping block 7. While it is essential that the clamping block, piezoelectric element, and damping substrate be selected to have similar coefficients of thermal expansion over the temperature range of use, the high temperature cushion in the form of a thin cloth or felt permits differential thermal expansion of the piezoelectric element and damping substrate relative to the clamping block while maintaining the desired pressure on the piezoelectric element.

The clamping block is made of a ceramic material such as those that are composed of $SiO_2$, $Al_2O_3$, $ZrO_2$, SiC and like materials in particulate or fibrous form. The positive electrode lead 3 is taken out of the central hole in this clamping block. The clamping block is then pressed on a high temperature cushion 6 and fastened to the piezoelectric protecting or delay block 5 with suitable hold down bolts 12.

The hold down bolts are preferably metallic bolts, such as those composed of steel, Ni, Mo, W, their alloys, or other like materials.

The ground electrode lead 9 is preferably made of most metals, or very high temperature resistant wires, such as those used in making thermocouples. This lead is secured on the hold down bolts 12 while the clamping block 7 is being bonded to piezoelectric protecting of delay block 5.

As already explained, in ultrasonic transducer devices made according to the prior art of transducer making, the critical bond between the active piezoelectric element and piezoelectric protecting or delay block either breaks prematurely or it severely restricts the usage of the device to limited lower temperature usage. This limitation has been overcome by, according to this invention, the clamping block 7 holding the piezoelectric element 1 to the protecting or delay block 5.

Furthermore, ultrasonic devices made according to this invention are not only operable to very high temperatures, but they also, typically, have 10 to 20 dB higher in sensitivity and output when compared with other similar devices commercially available.

Since the transducer devices according to this invention utilize high temperature stable and relatively low thermal expansion materials for piezoelectric element protection—when compared with high temperature unreliable plastic materials for piezoelectric element protection in the commercially available high temperature devices—the devices, according to this invention, are also more reliable. Therefore, the reliability of ultrasonic measurements when produced from devices made according to this invention is much higher than those made from similar commercial devices. This is because materials used in this invention are lesser prone to ultrasonic dependence of temperature phenomena when compared with those made from plastics, key materials used in currently available commercial ultrasonic devices.

Figure 3:
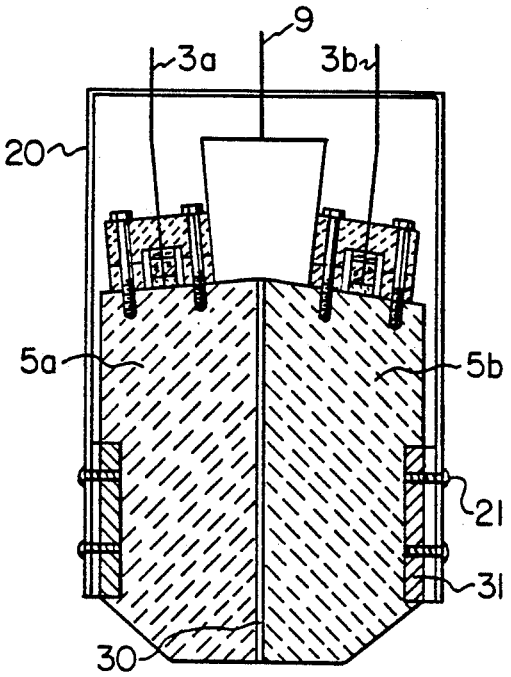
FIG. 3 is a section view of a dual element ultrasound transducer device according to this invention.

Referring now to FIG. 3, a dual element configuration is shown. This configuration is highly desirable when separate transmitter and receivers are required for higher resolution and detectability in defect detection, thickness and other measurements, particularly of those components and materials which suffer some type of corrosion during their service. Elements shown in FIG. 3 which are identical to those identified with reference to FIG. 1 are given the same number. Side-by-side delay faces 5*a* and 5*b* are separated by a thin ceramic tape 30. Each delay face is associated with its own piezoelectric element held in place by its own pressure cap connected to its own positive lead 3*a* or 3*b*. The two delay faces are held together by a clamping band 31.

Figure 4:
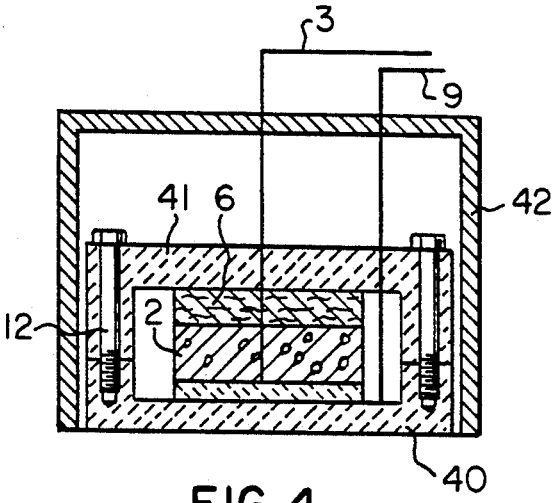
FIG. 4 is a section view of cap-cup embodiment of an ultrasound transducer device according to this invention.
Figure 5:
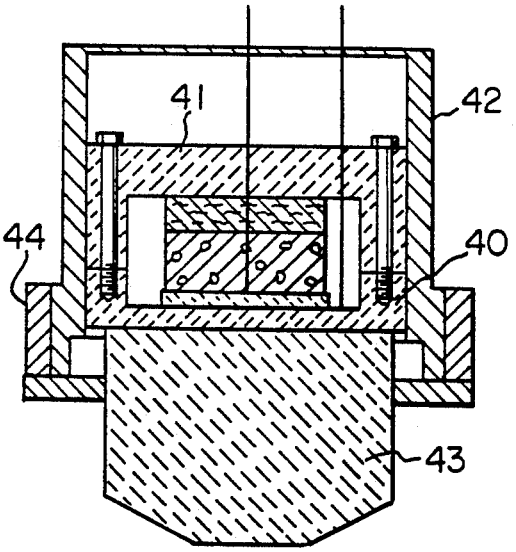
FIG. 5 is a section view of the cap-cup embodiment as shown in FIG. 4 further provided with an extended delay block; and, FIG. 6 is a diagram illustrating delay signals detected by a transducer as shown in FIG. 5 at room temperature and after the face of the delay has been at 510° C. for eight hours.

Referring to FIG. 4, there is shown yet another embodiment of this invention. In this embodiment, a ceramic cup 40 and the clamping block take the form of a ceramic cap 41. They are arranged with hollow ends facing. The cap and cup are surrounded by an outer canister housing 42. The remaining structure is the same as described with reference to FIG. 1. FIG. 5 shows a variation of the embodiment shown in FIG. 4 wherein a separate delay element 43 is secured by a ring 44 that threadably engages the canister housing 42.

Figure 6:
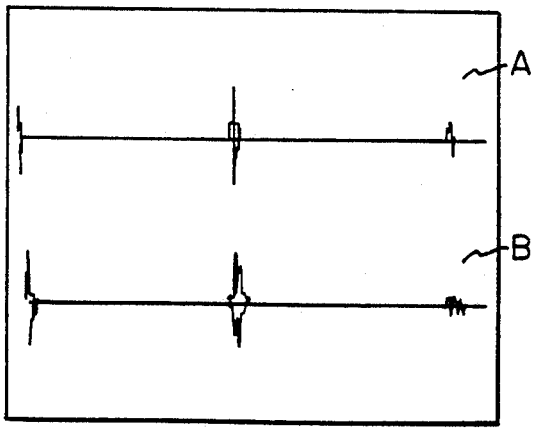

An ultrasound transducer device substantially as described with reference to FIG. 5 was constructed with a 6 mm active area diameter and a 5 MHz nominal frequency. The delay face was approximately 1 inch long. The face of the delay block was placed on a hot plate at 510° C. Pulse delay signals were recorded at time zero and after eight hours. The are reproduced as FIG. 6. Trace A is time zero and trace B after eight hours. The receiver attenuation at room temperature was 20 dB and after eight hours exposure at 510° C. was 14 dB. This was considered outstanding. Moreover the high temperature response of the delay was considered to be extremely stable.

The high temperature use of ultrasound transducer devices is restricted by several factors: (1) Curie point (temperature) of the active piezoelectric material, (2) reduction of electromechanical coupling factors of the piezoelectric material as a function of increasing temperature, even well below the Curie point and (3) evaporation or decomposition of adhesive material. By using suitable combinations of piezoelectric material, adhesive material, protecting or delay material, and other materials as described in this invention, it has been possible to operate the entire ultrasound transducer device with good ultrasonic signals at temperatures greater than 500° C. for long time periods. On the other hand, if the main body of the device according to this invention is kept under the ambient conditions, then the contact face of the protecting delay block can be subjected to withstand temperatures up to 1500° C. for short periods of time.

Having thus defined my invention in the detail and particularity required by the Patent Law, what is claimed and desired protected by the Letters Patent is set forth in the following claims.

I claim:

1. A hard faced contact ultrasound transducer device for transmitting ultrasound pulses into a workstructure at temperatures substantially above room temperature comprising:

a ceramic protection block having inner and outer surfaces, said outer surface being configured to contact the workstructure, a piezoelectric element having a front side and a back side, the front side being bonded to the inner surface of the protecting block, a damping substrate having front and back sides, the front side being adjacent the back side of the piezoelectric element, a ceramic clamping block having a contact face for being positioned facing the back side of the damping substrate and standoff portions that limit the approach of the clamping block toward the ceramic protecting block, fastener means to draw the clamping block toward the protecting block forcing the damping substrate against the piezoelectric element and the protecting block, whereby the piezoelectric element is mechanically held against the protecting block.

2. A transducer device according to claim 1 further comprising a ceramic cushion in the form of a ceramic cloth or felt between the clamping block and the damping substrate.

3. A transducer device according to claims 1 or 2 wherein the clamping block is in the form of a cap and the protection block is in the form of a cup.

* * * * *